US005307553A

United States Patent [19]

Frohlich

[11] Patent Number: 5,307,553

[45] Date of Patent: May 3, 1994

[54] CRIMPING TOOL

[75] Inventor: Hans Frohlich, Wangen im Allgau, Fed. Rep. of Germany

[73] Assignee: Zoller & Frohlich GmbH, Wangen im Allgau, Fed. Rep. of Germany

[21] Appl. No.: 781,181

[22] PCT Filed: Mar. 16, 1991

[86] PCT No.: PCT/EP91/00532

§ 371 Date: Nov. 4, 1991

§ 102(e) Date: Nov. 4, 1991

[87] PCT Pub. No.: WO91/14300

PCT Pub. Date: Sep. 19, 1991

[30] Foreign Application Priority Data

Mar. 16, 1990 [DE] Fed. Rep. of Germany ..... 4008515

[51] Int. Cl.[5] ..... H01R 43/04

[52] U.S. Cl. ..... 29/566.2; 29/751

[58] Field of Search ..... 29/751, 753, 566.2, 29/566.3, 566.4

[56] References Cited

U.S. PATENT DOCUMENTS

| | | | |
|---|---|---|---|
| 3,032,770 | 5/1962 | Anderau | 1/177 |
| 3,492,854 | 2/1970 | Eppler | 72/412 |
| 3,710,610 | 1/1973 | McCaughey | 72/410 |
| 4,173,067 | 11/1979 | Stiener et al. | 29/749 |
| 4,809,571 | 3/1989 | Hatfield | 81/355 |
| 4,825,735 | 5/1989 | Undin | 81/352 |
| 4,953,384 | 9/1990 | Baillet et al. | 72/410 |
| 4,980,962 | 1/1991 | Wiebe | 29/566.2 |

FOREIGN PATENT DOCUMENTS

| | | |
|---|---|---|
| 0380388 | 1/1990 | European Pat. Off. . |
| 597178 | 4/1934 | Fed. Rep. of Germany . |
| 3109289 | 1/1982 | Fed. Rep. of Germany . |
| 3205110 | 9/1983 | Fed. Rep. of Germany . |
| 3347323 | 7/1984 | Fed. Rep. of Germany . |
| 3508354 | 9/1985 | Fed. Rep. of Germany . |

*Primary Examiner*—Carl E. Hall

*Attorney, Agent, or Firm*—Handal & Morofsky

[57] ABSTRACT

A crimping tool resembling tongs is disclosed, with an anvil in which, by means of the swing of a handle, a component can be supplied, via a feed device, to the anvil and in the latter is capable of being crimped with the cable end, where the swing motion of the handle is transmitted via a transmission mechanism to close the anvil, which is designed so that the anvil, at the end of the swing range of the handle, is to open for removal of the crimp connection. Feed of the component to the anvil is effected by means of a transport linkage and a transport fork, which by way of a control element are in active communication with the transmission mechanism, so that the rate of motion of the transport fork is capable of being influenced in the entire range of swing of the movable handle.

54 Claims, 13 Drawing Sheets

CRIMPING TOOL

BACKGROUND OF THE INVENTION

The invention concerns a crimping tool.

The solderless connection of electrical components (so-called "crimp connections") is gaining increasing importance, especially for "on site" assembly. Thus, for production reasons, for example, it is substantially more convenient to furnish cable ends provided for a clamping connection by crimp connection with an end sleeve instead of soldering the strands of the cable end together. The generic hand compression tools disclosed in, for example, DE-OS 3,109,289, are generally used for crimping.

In the prior art the components to be crimped are first assembled loose in an initial operation, then fed to the crimping tool, squeezed together by actuation of the actuating means of the crimping tool and, in a last operation, removed from the tool. Such a work sequence—measured against the entire time it takes to produce a clamped joint—requires a relatively long period of time.

In an attempt to minimize the time required to produce the crimp connection, efforts have been made to utilize machinery to produce crimp connections, as disclosed for example in DE-OS 3,508,354, in industrial use. It has been found, however, that such machinery is suitable only for stationary use since, on the one hand, it has a relatively high intrinsic weight and, on the other, is operable only in conjunction with power connections (compressed air, electric current).

SUMMARY OF THE INVENTION

The object of the invention is to refine the crimping tool to allow simplified production of a crimp connection.

According to one embodiment of the invention squeezing two components together and feeding one of the components to the anvil via a feed means by a single operation of the actuating means makes it unnecessary to assemble the two components outside the hand-operated crimping tool. This allows the crimping operation to be substantially abbreviated as compared with compression with a known crimping tool.

It is especially advantageous when a centering means is assigned to the crimping tool, so that the other component can be fed in the correct position.

An embodiment permits an especially space-saving storage of the components fed in the crimping tool. A magazine may be attached removable to the crimping tool, so as to allow more rapid magazine replacement.

An especially easy-to-handle crimping tool is obtained the components of the anvil susceptible to wear are replaceable.

It is possible to design the feed means in the direction of motion of the movable handle, so that, particularly in conjunction with the feed means a tool with a small width can be produced.

The crimping tool may be suitable for both left-handed and right-handed persons.

Transmission mechanisms enable a sufficient amplification of the manual force exerted in each instance to be obtained with little apparatus, where the opening motion of the movable working arm is controllable by the suitable selection of lever lengths and angle of inclination.

The feed means makes it possible to convert the motion of the handle into a motion of transport of the component to the anvil, the component in the region of the anvil being fixed in place by a hold-down member in the direction of the bearing surface.

An embodiment enables the transport motion to be delayed with respect to the opening motion of the working arm, in order to prevent, for example, collision of the component transported to the cavity with an element of the opening compression jaw.

It is especially advantageous when the component to be fed from outside can be introduced into the component located in the cavity through a centering opening, and the centering opening can be moved apart by a suitable mechanism for removal, through the centering opening, of the components to be crimped from the crimping tool.

Separating means allows an exact separation of the connecting straps of the belt band from the component to be crimped. In butt cutting, i.e., in butt placement of the cutting edges on the plane of shear the cutting means, is cushioned in the movable working arm, while for the formation of planes of shear only an adjustment of the cutting depth is effected.

The crimping tool according to the invention is especially suitable for crimping multiple-wire end sleeves with cable ends.

An embodiment allows the transport motion, in particular the rate of transport of the component to be crimped, to be influenced almost as desired over the entire feed path, so that optimal matching of the forward feed of the transport fork to the opening and closing motion of the working arm is possible. Since the control element in the form of a forced control acts directly on the transport linkage, the necessity for providing a complicated spring/catch mechanism is eliminated.

A crimping tool of especially simple design, is obtained wherein the forward feed motion of the transport fork is capable of being influenced by the design of the control surface.

An embodiment permits a further improvement in the functional reliability of the crimping tool in that automatic return swing of the movable handle is possible only upon removal of the crimp connection.

An embodiment actuation of the crimping tool when cable ends have not been introduced.

BRIEF DESCRIPTION OF THE DRAWINGS

Some preferred examples of the invention are explained in detail below with the aid of schematic drawings, wherein.

DETAILED DESCRIPTION OF THE INVENTION

An embodiment of the is explained below in terms of compressing multiple-wire end sleeves 13 with bare cable ends 18. However, it is expressly pointed out that the principle of the invention is applicable to the solderless compression connection of components of virtually any shape.

The example of a crimping tool in the form of hand tongs, shown in

Figure 1:
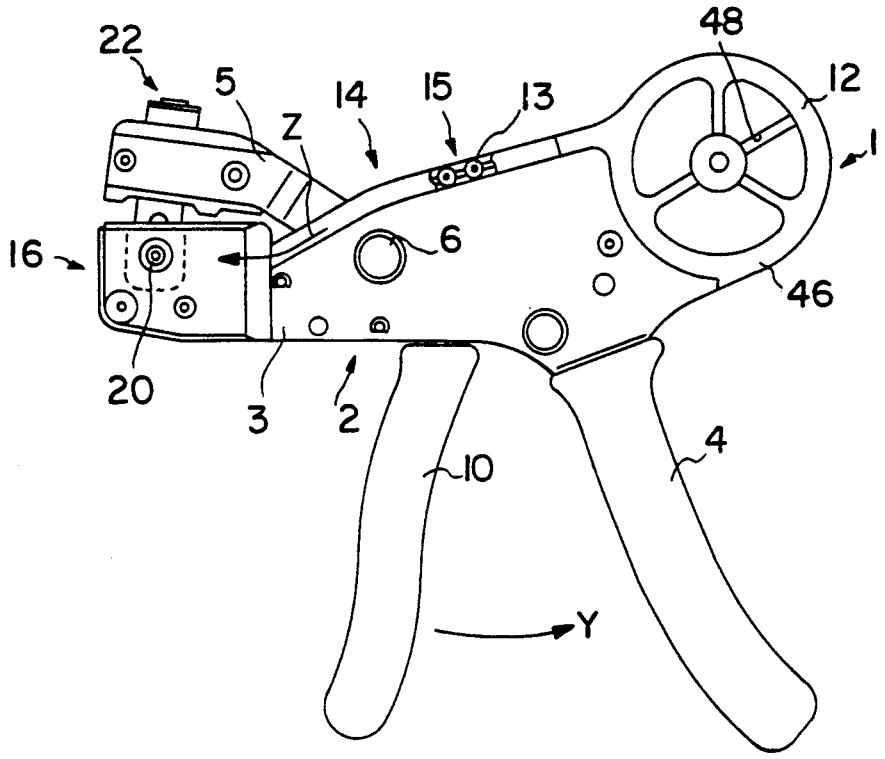
FIG. 1 shows a side view of hand tongs according to the invention.

FIG. 1, has a basic body 2 with a stationary working arm 3, from which a counter-holder 4 designed as a handle extends downward. A movable working arm 5 is seated in the basic body 2 swinging about a hinge pin 6 and connected via a transmission mechanism 8 (see FIG. 4) with a movable handle 10, which in turn is capable of swinging in the direction of the counter-holder 4 to close the movable working arm 5. In the region of the counter-holder 4 a magazine 12 is seated in the basic body 2 for receiving a coiled belt band 15 of multiple-wire end sleeves 13, which are capable of being fed via a feed means 14 to the lower part of an anvil 16.

The movable working arm 5 bears a separating means 22 for separating the end sleeve 13 from the belt band 15.

Figure 2:
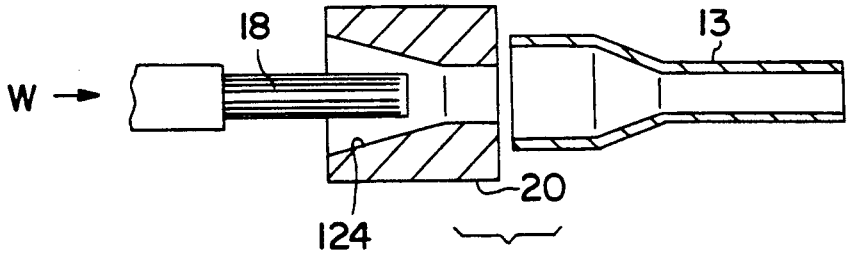
FIG. 2, a schematic representation of the centering of a cable end relative to an end sleeve.

According to FIG. 2, the cable end 18 to be crimped is fed to the lower part of the anvil 16 via a centering means 20 arranged laterally on the stationary working arm 3.

In the starting position of the hand tongs 1 illustrated in FIG. 1, a multiple-wire end sleeve 13 to be separated is located in the lower part of the anvil 16, the end sleeve 13 being arranged in its longitudinal extension transverse to the direction of closing Y of the handle 10. The bare cable end 18 is introduced manually by the user of the tongs 1, by way of the centering means 20, into the end sleeve 13 located in the lower part of the anvil 16 (see FIG. 2). The closing motion of the movable handle 10 in Y direction is converted via the transmission mechanism 8 into a closing motion of the movable working arm 5, whereby the anvil 16 is closed, the multiple-wire end sleeve 13 is separated and the cable end 18 is crimped with the end sleeve 13.

As is explained in still greater detail below, the motion of the movable working arm 5 is controlled so that the anvil 16, after the crimping operation, opens easily in the end swing position of the handle 10 to release the crimped components 13, 18. With the return swing of the handle 10 the movable working arm 5 is moved back into its basic position and the next end sleeve 13 fed along the feed means 14 in the direction Z to the lower part of the anvil 16, so that the tongs 1 are ready for the next crimping operation. Manufacturing variations in the diameter of the end sleeve 13 or of the cable end 18 are compensated by the intrinsic elasticity of the movable and stationary working arms 3, 5. In the case of components with fairly great deviations from the specified size, the hinge pin 6 may be seated in an elastic element of the basic body 2, through the elastic deformation of which the variation in size can be compensated.

Figure 3:
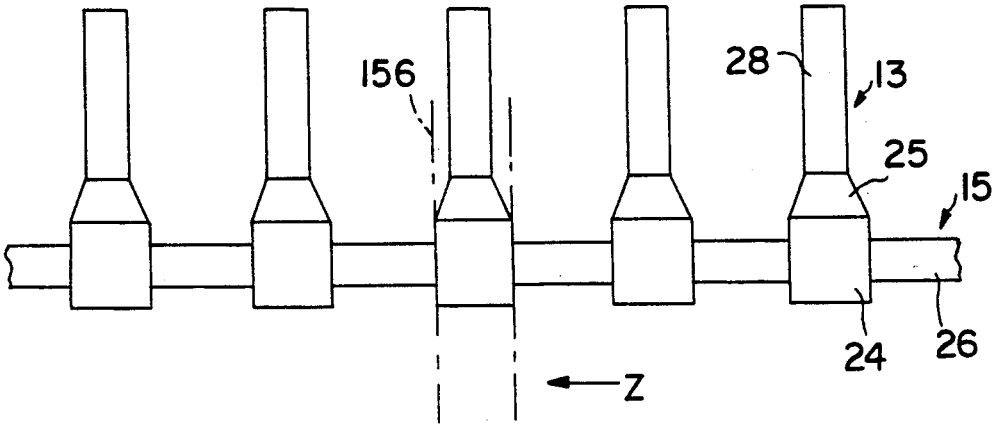
FIG. 3, a belt band for use in hand tongs according to FIG. 1.

As can be seen in FIG. 3, in the belt band 15 the multiple-wire cable ends, in their longitudinal extension, are arranged transverse to the direction of transport Z and are joined together along a radially expanded cylindrical sleeve section 24 by connecting straps 26. The sleeve section 24 and the connecting strap 26 advantageously are made in one piece of synthetic material, preferably polypropylene, and sprayed, for example, in the injection molding process, on a metallic sleeve which forms the crimp section 28 of the end sleeve 13, the cylindrical sleeve section 24 being tapered toward the metallic sleeve via a conical connecting section 25. The belt bands 15 contain, for example, 100 multiple-wire end sleeves, since it has been shown in test runs that this number represents a compromise between the contradictory demands for as great as possible a storage volume of the magazine 12, on the one hand, and for the lowest possible weight of the tongs 1, on the other.

Figure 4:
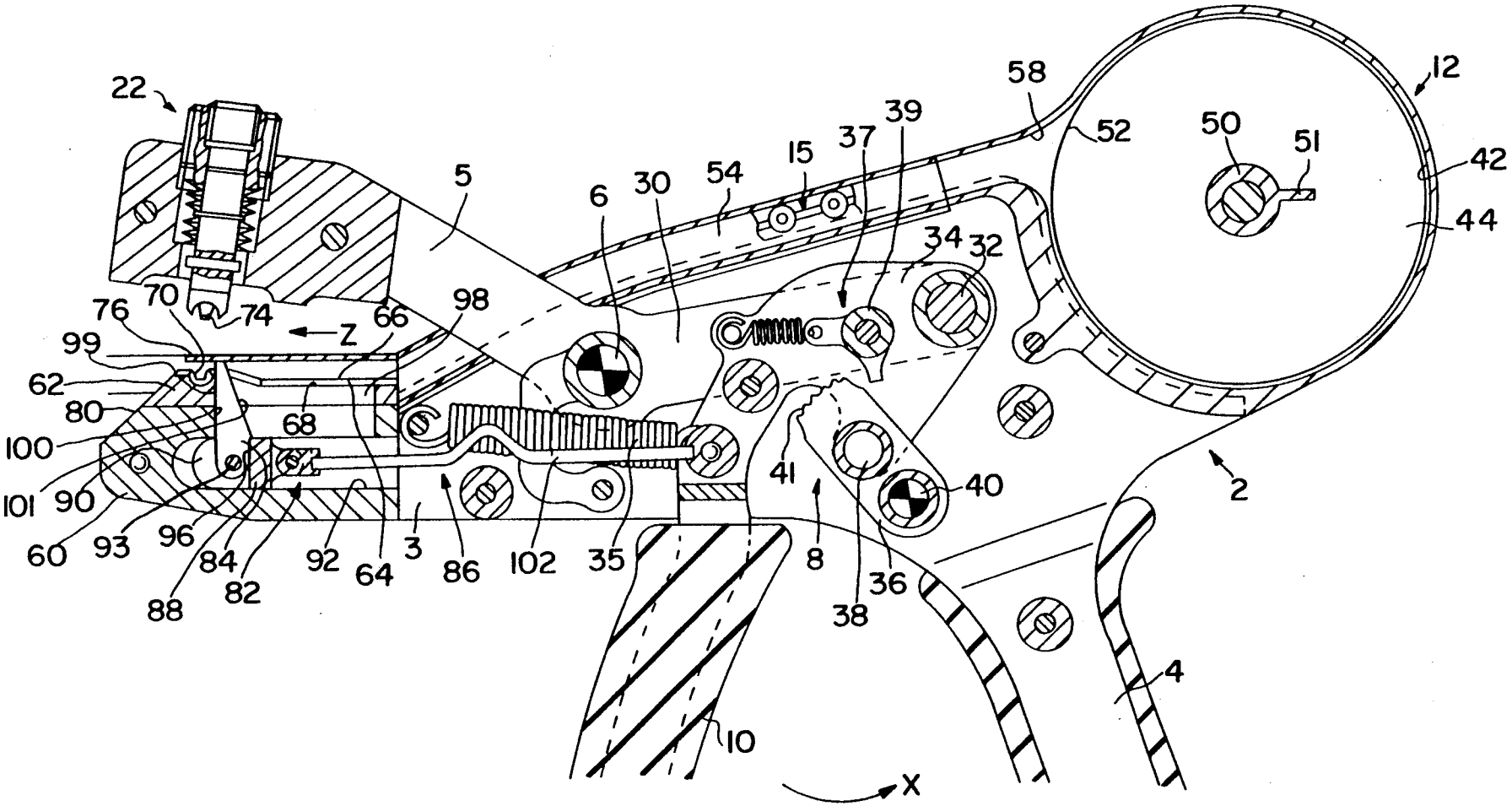
FIG. 4, a sectional representation of the hand tongs in FIG. 1.

According to FIG. 4, the movable working arm 5 is connected via a four-bar mechanism 8 with the movable handle 10. There the working arm 5 is extended beyond the hinge pin 6 to a driven crank 30, which at its end section distant from the hinge pin 6 bears a first hinge pin 32, to which a coupling member 34 extending to the counter-holder 4 is linked. The said coupling member in turn is connected articulated, at its end section on the counter-holder side, via a second hinge pin 38, with a driving crank 36 which is capable of swinging about a second hinge pin 40, which is fastened in the basic body 2 forming the lock of the four-bar mechanism. The movable handle 10 enters the basic body 2 via an elongated slot, not shown, and in its prolongation is curved toward the first hinge pin 32 and formed in one piece with the coupling member 34. The handle 10 is pretensioned against the direction of swing Y by a tension spring 35 fastened in the basic body 2.

The lever lengths and angle of swing of the members of the four-bar mechanism are selected so that upon swinging of the handle 10 toward the counter-holder 4 the coupling member 34 and the driving crank 36 are capable of being brought into a straight extended position, in which the maximum compressive force is transmissible to the movable working arm 5.

Figure 5:
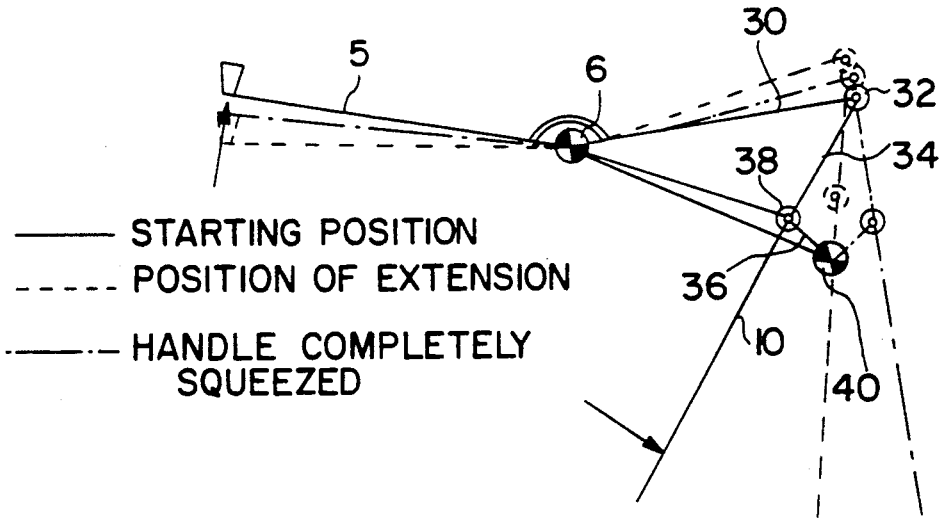
FIG. 5, a schematic representation of the lever positions on actuation of the tongs.

The relative motions of the four-bar mechanism during the motion of the handle 10 toward the counter-holder 4 are represented schematically in FIG. 5. The starting position of the members of the four-bar mechanism, which can be seen in FIG. 4, is identified in FIG. 5 by solid lines. In the extended position (broken line) the free hinge point 32 in FIG. 5 travels upward, so that the working arm 5 is swung about the fixed hinge point 6 downward into the crimping position. Upon further motion of the handle 10 toward the counter-holder 4

(dot-and-dash line), the free hinge point 38 travels beyond the extended position, owing to which the free hinge point 32 moves downward and the working arm is swung upward about the fixed hinge point 6, so that the tongs 1 open. During the return motion of the handle 10 from the closed position the four-bar mechanism and, with it, the movable working arm 5, traverses the positions described above in reverse sequence, until the starting position is again reached.

Safety regulations in the manufacture of solderless electrical connections require that upon swing of the handle 10 a forced crimp must be guaranteed, i.e., that the tongs can open only after a complete swing of the handle 10. To prevent an incomplete swing of the handle 10, a locking means 37 known per se is assigned to the transmission mechanism 8. The said locking means has a safety catch 39 which, against spring pretension, is seated rotatable on the coupling member 34. During swing of the coupling member 34 relative to the driving crank 36, the safety catch 39 comes into locking engagement with a toothed section 41 of the driving crank 36 prolonged past the hinge pin 38. The latter allows further motion of the driving crank 36 only in the direction in which the locking engagement was made. Motion in the opposite direction is possible only after the locking engagement between the safety catch 39 and the toothing 41 is released by a complete swing of the driving crank 36 into its end position (broken line in FIG. 5).

As can be seen in FIG. 4, at the upper back end section in the region of the counter-holder 4, the magazine 12 is designed in one piece with the basic body 2 of the hand tongs 1. The magazine 12 has a drum-shaped casing 42 which on one side is closed off by a side face 44 of the basic body 2 and on the other side by a magazine covering 46 (see FIG. 1), which is removable from the basic body 2 for replacing a belt band roll 15. In the magazine covering 46 are formed recesses 48, through which the fill status of the magazine 12 can be determined. For receiving the belt band 15 wound on a spool (not shown), a centric spool shaft 50 with a follower 51 is seated rotatable in the magazine 12. In the vicinity of the spool body (not shown), a recess for form-locking accommodation of the multiple-wire end sleeve 13 located at the end of the belt band may advantageously be located, so that the belt band 15, fixed against rotation, is connected with the spool.

In an upper section of the casing 42 facing the movable working arm 5, a recess 52 is formed for passage of the belt band 15. Connected to the latter is a box-shaped guide shaft 54 for the belt band 15, which is formed on the upper side of the basic body 2. In FIG. 4 the guide shaft 54 runs obliquely downward to a compression jaw 60 of the stationary working arm 3, which is formed of an insert in the end section of the stationary working arm 3. To permit immediate correction of any disturbances in transport of the belt band 15, an oblong slot 59 extending along the guide path (see FIG. 6) is formed on the covering surface 58 of the guide shaft 54. The guide shaft 54 opens into a guide section of the stationary compression jaw 60.

The lower part 62 of the anvil 16 is fastened detachably to the surface of the compression jaw 60 facing the movable working arm 5. As may be seen in FIGS. 4 and 6, the lower part 62 has a guide surface 66, elevated toward the movable working arm 5, on which the crimp section 28 of the multiple-wire end sleeve 13 rests. The guide surface 66 is followed, transverse to the direction of transport Z, by a contact section 64, on which the connecting section 25 of the end sleeves 13 rests for transverse conveyance. The contact section 64 drops down all the way to a sleeve guide surface 68 for conveyance of the sleeve section 24. The multiple-wire end sleeve guide formed by the guide surface 66, the contact section 64 and the sleeve guide surface 68 rises toward a horizontal section in the direction of transport Z to the movable working arm 5 and opens into a cavity 70, in which a casing section of the end sleeve 13 is accommodated form-lockingly.

The section of the cavity 70—the bottom die 72—provided for receiving the crimp section 28 has a trapezoidal cross section, into which an upper die 74 penetrates. The depth of insertion and the dimensions of the die 72 and the die 74 are sized so that the strength values of the crimp connection prescribed, for example, in DIN 41611 are obtainable. The crimping depth at a cable cross section of 1.5 $mm^2$ is normally about 1 mm. Since the design of the bottom die 72 and the upper die 74 are already essentially known from the prior art mentioned, a more detailed description is omitted at this point.

Figure 6:
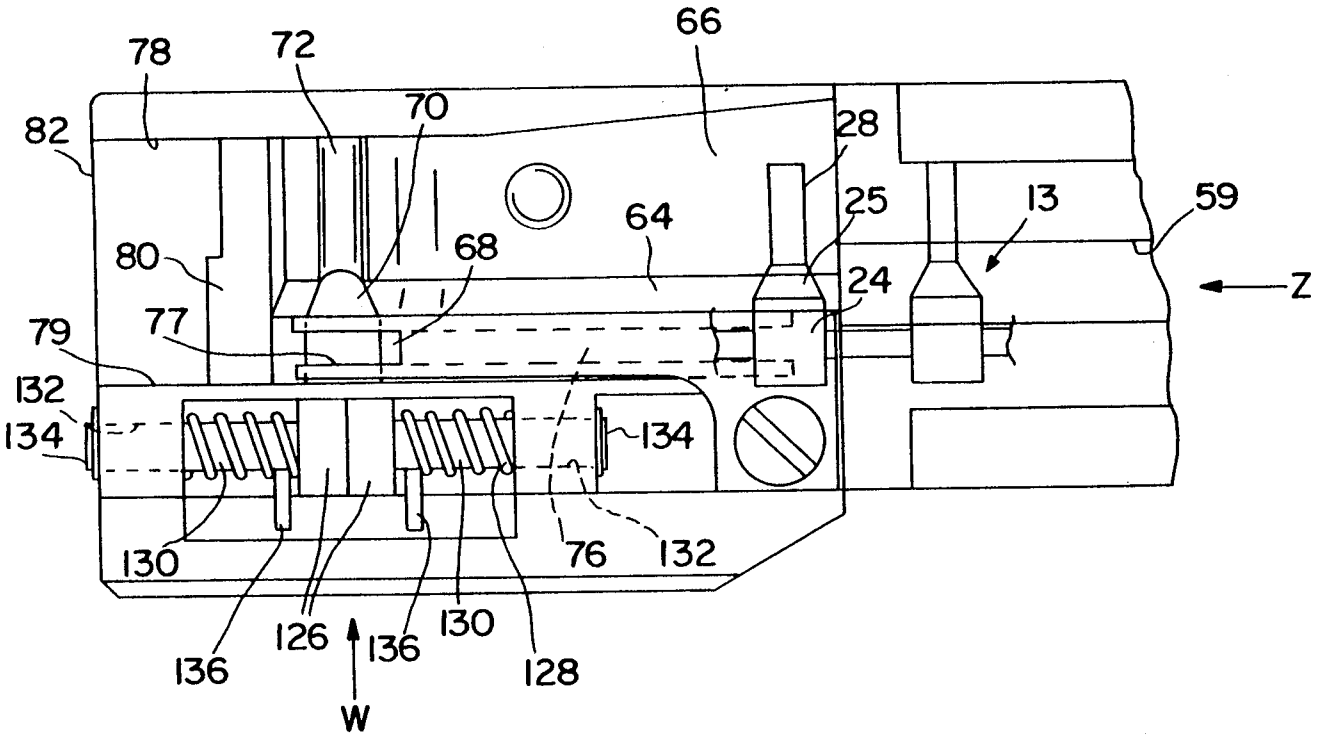
FIG. 6, a top view of a movable working arm of the tongs in FIG. 1.

As may be seen in FIGS. 4 and 6, in the space over the sleeve guide surface 68 there is arranged a hold-down member 76, extending from the cover surface 58 to the cavity 70, by which the sleeve section 24 is pressed elastically against the sleeve guide surface 68 and the corresponding section of the cavity 70, so that the end sleeve 13, during transport to the cavity 70, is guided in vertical direction and in compression position. The hold-down member 76, in the region of the guide shaft 54, is bolted with a bearing block (not shown) of the basic body 2. The free end section of the hold-down member 76 located over the cavity 70 has a fork-shaped recess 77, into which the separating means 22 penetrates to separate the multiple-wire end sleeve 13 from the adjacent connecting straps 26. The inside diameter of the recess 77 corresponds to about the width of the connecting strap 26.

The front-end conveyance of the end sleeve 13 is effected by lateral guide surfaces 78, 79 (see FIG. 6) which are formed on the lower part 62 in the direction of transport Z. The guide surfaces 78, 79 are arranged in prolongation of the side faces of the guide shaft 54 and flare out toward the cavity 70. The guide surfaces 78, 79 of the hold-down member 76 and the surfaces 64, 66, 68 permit precise alignment of the belt band 15 and of the end sleeves 13 to be crimped with reference to the cavity 70.

In the direction of transport Z the cavity 70 is followed by a delivery surface 80, formed on the insert and running obliquely downward, along which a connecting strap 26 separated during the crimping process can be discharged from the basic body 2 by the effect of gravity.

Feed of the belt band 15, or more accurately, of the multiple-wire end sleeve 13 to be crimped, into the cavity 70 is effected via a transport means 82, which according to FIG. 4 is linked, for example, to the movable handle 10. The transport means 82 of course could alternatively be in active communication with other structural elements of the transmission mechanism 8. In the examples shown in FIGS. 4 and 7, the transport means 82 has a transport linkage 86, which is connected by its end section facing the magazine 12 articulated with the movable handle 10. To the other end section is linked a sliding block 88, in whose receiving section 90 is seated a transport fork 84 capable of swinging around about 90°. The sliding block 88 is guided in a slide guide 92 of the compression jaw 60 running essentially parallel to the hold-down member 76. In the example shown, the transport fork 84 consists of two separate arms, spaced apart, which are fastened form-lockingly on a hexagonal pin 93, which in turn is seated rotatable in the receiving section 90. The transport fork 84 is pretensioned by a torsion spring 94 against the sliding block 88 and lies in the vertical transport position 84 (see FIGS. 4, 7) on a contact surface 96 of the sliding block 88. The end sections of the transport fork 84 there extend through two parallel elongated slots 98 in the compression jaw 60 following the slide guide 92 in vertical direction and in the lower part 62 of the anvil 60 to the fork-shaped recess 77 and end in the section of the sleeve guide surface 68 rising toward the cavity 70. The length and spacing of the arms is selected in such fashion that, in the view of FIG. 8, they connect to the recess 77, so that the connecting strap 26 of the multiple-wire end sleeve 13 can be embraced by the transport fork 84 transverse to the direction of transport Z.

Figure 7A:
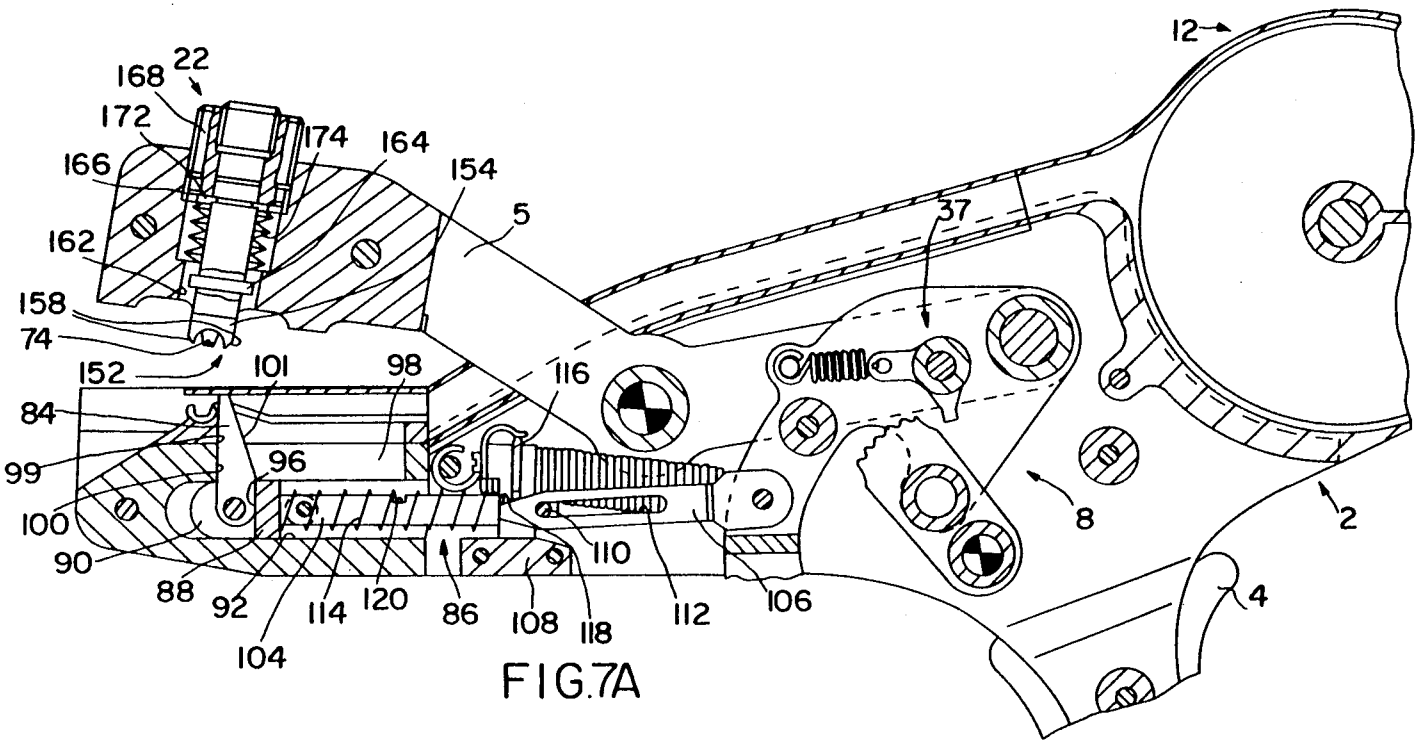
FIG. 7A, a longitudinal section through another example of hand tongs.
Figure 7B:
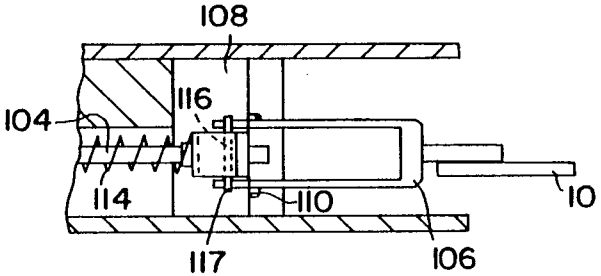
FIG. 7B, an enlarged portion of FIG. 7A.

In the front position of the transport means 82 viewed in the direction of transport Z, i.e., in the starting position represented in FIGS. 4, 7, the arms of the transport fork 84 rest, by their side edge 99 turned away from the contact surface 96, on a detent 100 formed by the end section of one of the longitudinal slots 98 and—viewed in the direction of transport Z—on the front cover section of the sleeve section 24. The side edge 101 of the transport fork 84 distant from the detent 100 is tapered toward the free end and upon motion of the transport fork 84 comes into contact, against the direction of transport Z, with the adjacent end sleeve 13. At the same time, the transport fork 84 is swung against the pretension of the torsion spring 94 into the position of insertion underneath the multiple-wire end sleeve 13 and slides off along the side edge 101 to the adjacent end sleeve 13, until the free end of the transport fork 84 is swung back, by the spring effect, behind the adjacent end sleeve 13 into the vertical transport position, so that upon a following transport motion of the transport fork 84 the side edge 99 again comes to rest on the adjacent end sleeve 13.

In the simplest embodiment according to FIG. 4, the transport rod 86 is formed by a one-piece rod 102, which connects the movable handle 10 with the sliding block 88, so that the swing of the handle 10 is immediately converted into a motion of the sliding block 88 and hence of the transport fork 84 along the slide guide 92 and the longitudinal guide slot 98. The detent 100 for the transport fork 84 thus likewise forms the detent for the handle 10 held in its starting position by the spring pretension of the tension spring 35.

However, it may be advantageous when the motion of the transport fork 84 in the direction of transport Z is delayed with respect to the return motion of the handle 10 and hence the opening motion of the movable working arm 5. To realize such kinematics, according to FIG. 7 the continuous rod 102 found in FIG. 4 is formed by a connecting rod 104 linked to the sliding block 88 and a tension fork 106. The end section of the connecting rod 104 distant from the sliding block 88 is seated in elong . . . [line or lines missing] bearing block 108 and connected articulated by a carrier pin 110 with the fork-shaped end section of the tension fork 106 embracing the connecting rod 104 and the bearing block 108, the carrier pin 110 being guided sliding in oblong holes 112 of the tension fork 106. The sliding block 88 is pretensioned in the direction of transport Z by a compression spring 114, which is supported on the adjacent side face of the bearing block 108. A catch member 116 is guided in the bearing block 108 essentially perpendicular to the longitudinal extension of the connecting rod 104, which catch member is capable of being brought, against spring pretension, into engagement with a notched groove 120 formed on the connecting rod 104 at the predetermined distance from the carrier pin 110. The side end sections 117 of the catch member 116 extend out at either side of the bearing block 108 beyond the arms of the tension fork 106, so that the catch engagement, upon motion of the tension fork 106 in the direction of transport Z, is capable of release by contact of the side end sections 117 on an oblique guide surface 118 of the tension fork 106.

According to FIG. 7, in the starting position the carrier pin 110 rests on the bearing-block-side end of the oblong hole 112, so that the swinging motion Y of the handle 10 is transmitted directly, via the tension fork 106 and the connecting rod 104—as in the example in FIG. 4—to the transport fork 84. The distance of the groove 120 from the carrier pin 110 is sized so that the catch member 116, when the handle 10 has swung completely, engages in the groove 120 and thus the motion of the connecting rod 104 is blocked. When the handle 10 swings back the oblong hole 112 permits motion of the tension member 106 relative to the blocked connecting rod 104, whereupon the catch member 116 is moved upward, by the oblique guide surface 118, against spring pretension until the catch engagement, after a predetermined relative motion between tension fork 106 and connecting rod 104, is released, and the connecting rod 104 is moved in the direction of transport Z by the compression spring 114 until the transport fork 84 rests on the detent 100. In this example belt band transport is thus effected by the spring force of the compression spring 114, while the tension spring 35 serves only for the return motion of the handle 10.

Coaxially to the multiple-wire end sleeve 13 located in the cavity 70 there is formed in the side cheek of the stationary compression jaw 60 the centering means 20 (see FIGS. 6, 8, 9), through which the bare cable end 18 can be introduced, in the direction of transport Y, into the end sleeve 13 viewed from the left (arrow W). There the funnel-shaped centering opening 124 according to FIG. 6 is formed by two centering jaws 126 capable of moving apart, which are arranged transverse to the centering axis in recesses of the lower part 62 and are in each instance pretensioned by a tension spring 128 in the direction of the centering axis, i.e., in closing direction. The inside diameter of the centering opening is selected slightly greater than the diameter of the bare cable end 18. The motion apart of the centering jaws 126 enables the end sleeve 13 crimped with the cable end 122 to be removable from the centering means 20 away from the direction of feed W. In the end section of each centering jaw 126 distant from the centering axis there is fastened a guide pin 130 extending parallel to the direction of closing, which pin in turn is guided in a slide guide 132 of the lower part 62 and whose motion in the direction of closing is limited by a safety ring 134. The safety ring 134 comes into contact with the adjacent face of the slide guide 132 when the centering jaws 126 are closed in the centering position. In this way it is ensured that the centering jaws 126, even in case of unlike spring constants of the tension spring 128—caused, for example, by material fatigue or manufacturing tolerances—close in the centering position and not displaced laterally thereto. At a predetermined distance from the centering axis, a stop pin 136, which projects beyond the side face of the basic body 2, in each instance extends away from the guide pin 130, against the direction of feed W.

For rough centering of the cable end 18, a precentering plate 138 with a preliminary funnel 140 formed coaxially to the centering axis (see FIG. 8) may be fastened to the side face of the basic body 2. In such an embodiment, the two stop pins 136 are arranged in a recess 142 in the side face of the centering plate 138 resting on the basic body 2.

Figure 9:
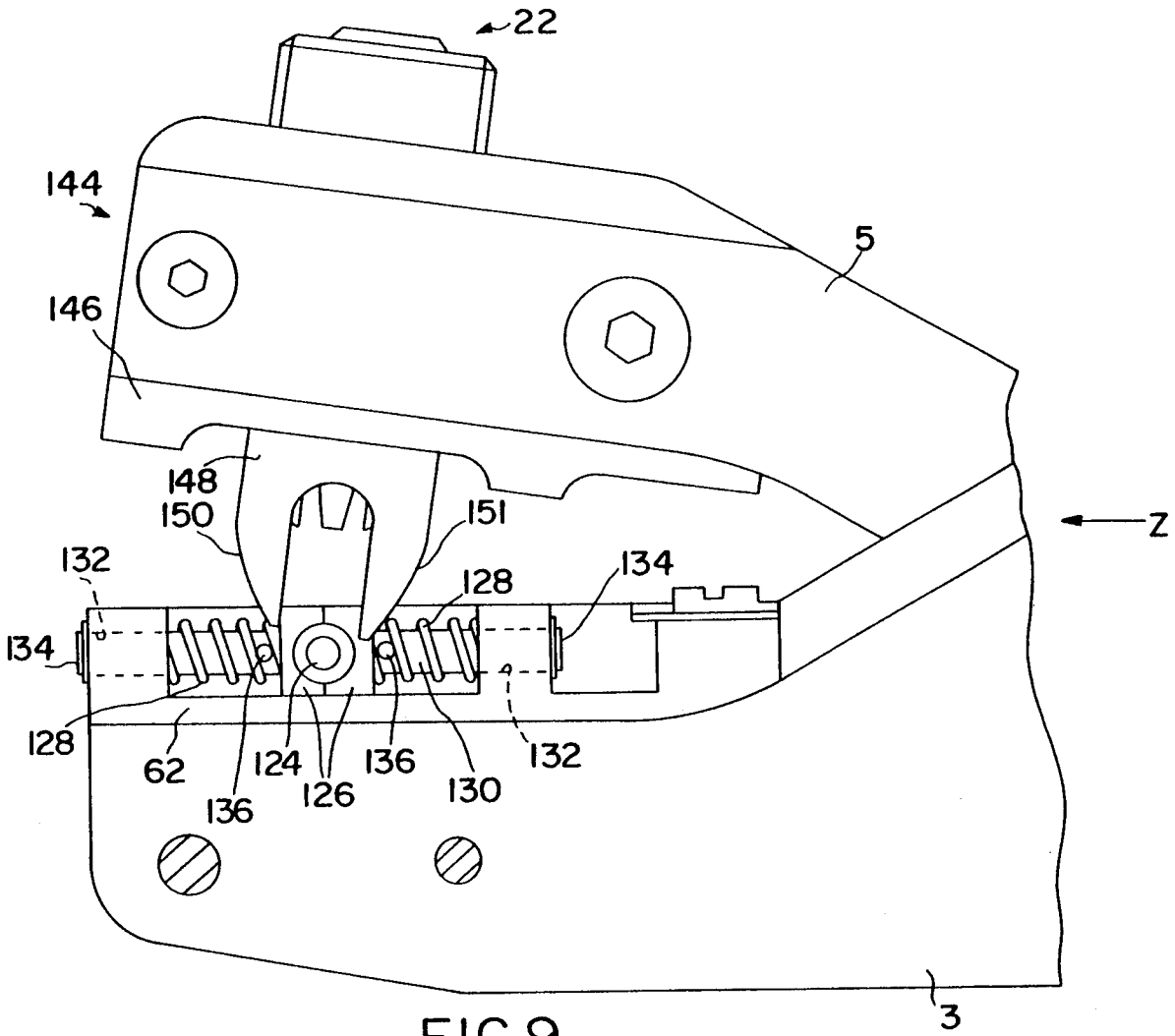
FIG. 9, a front view of a centering means.
Figure 10:
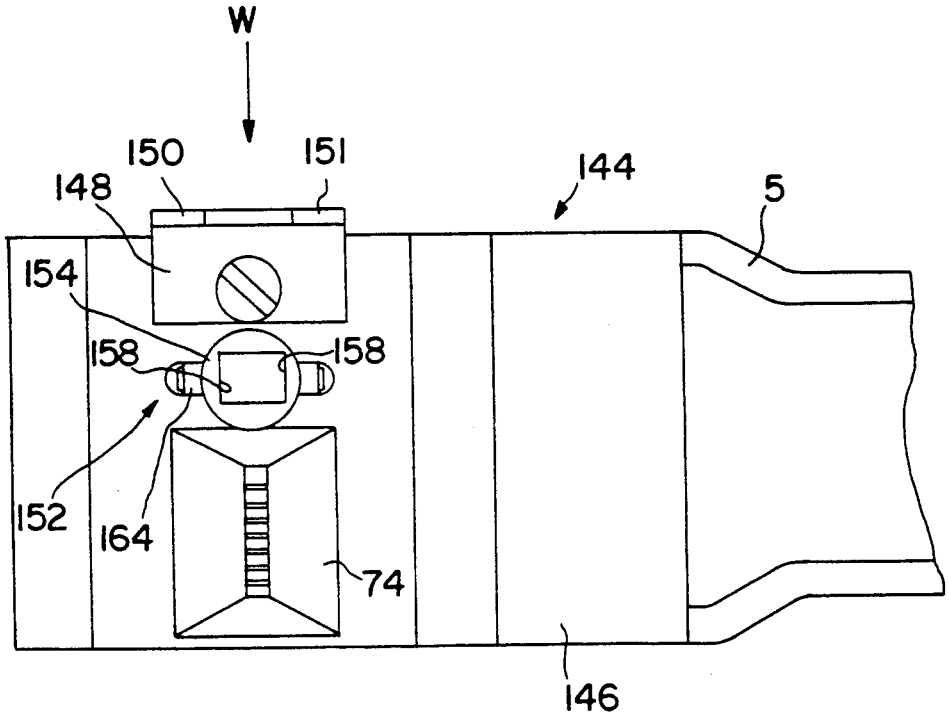
FIG. 10, a top view of a movable compression jaw.

As in the stationary working arm 3, the compression jaw 144 of the movable working arm 5 is formed by a replaceable insert 146. According to FIGS. 9 and 10, this insert 146 bears a fork-shaped opening wedge 148 assigned to the stop pin 36, whose wedge surfaces 150, 151, extending in the direction of the stationary working arm 3, come to rest on the stop pins 136 when the tongs 1 close and thereby move the centering jaws 126 apart. When a precentering plate 138 is employed, the opening wedge 148 enters the recess 142.

The distance between the two arms of the opening wedge 148 embracing the centering opening 124 is sized so that removal of the crimped components when the centering jaws 126 are open is not hindered.

Figure 8:
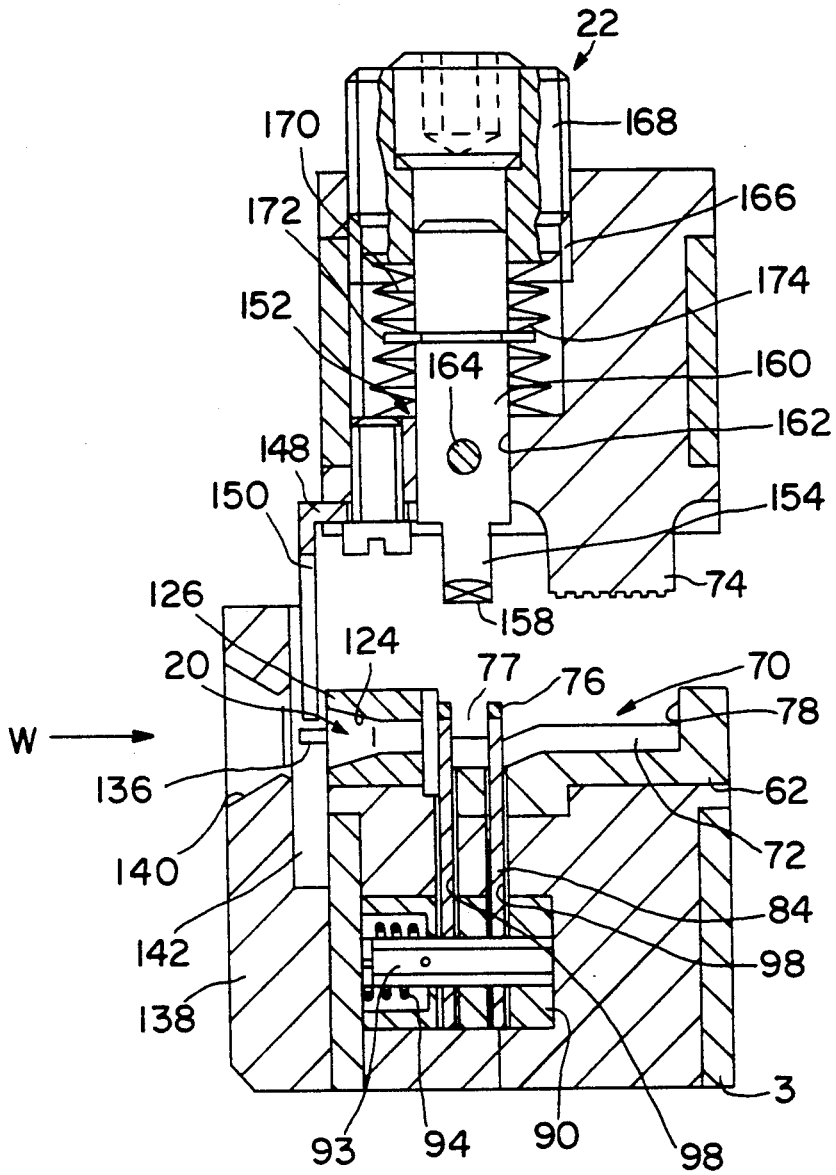
FIG. 8, a section through a side view of the tongs in FIG. 1.

According to FIG. 8, a cutting means 152 of the separating device 22 is seated, in the direction of feed W, behind the opening wedge 148 in the compression jaws 144. The cutting means 152 has two cutting arms 154 which, when the tongs 1 are closed, embrace the sleeve section 24 of the multiple-wire end sleeve 13 to be crimped in the region of the connecting straps 26 in the direction of transport Z, so that the latter are separable along the ties 156 (see FIG. 3). The cutting edges 158 of the cutting arms 154 thus run in a plane parallel to the ties 156. The width and length of the cutting arms 154 are sized so that when the tongs 1 are closed they engage between the recess 77 of the hold-down member 76 and the arms of the transport fork 84. Toward the movable compression jaw 144 the cutting arms 154 are converted into a cutting cylinder 160, which is guided in vertical direction in a guide recess 162 of the insert 146 (FIG. 8) and is secured against twisting by a transverse pin 164. The guide recess 162 opens into a radially enlarged threaded hole 166, into which an adjusting screw 168 accessible from the upper side of the hand tongs 1 is screwed.

In the example of FIGS. 4, 8 the adjusting screw 168, in screw-in direction, rests on a first spring 170—preferably formed by a cup spring package—which in turn is supported on a support ring 172. The latter is fastened in a peripheral groove of the cutting cylinder 160. The end section of the cutting cylinder 160, extending axially beyond the support ring 172, is guided in a bore of the adjusting screw 168 arranged coaxially to the guide recess 162. The front of the support ring 172 facing the cutting edges 158 rests on a second spring 174, which is supported on the bottom of the threaded hole 166. The elastic force of the first spring 170, applied when the adjusting screw 168 is screwed down, is transmitted, through the support ring 172, to the second spring 174 so that, through its spring path, the cutting depth of the cutting edges 158 is adjustable in such a way that, when the tongs 1 are closed, they come to rest on the sleeve guide surface 68. I.e., the connecting straps 26 of the belt band 15 are separated by butt placement of the cutting edge 158 against the sleeve guide surface 68. In this example the first spring 170 serves to absorb the shock of the cutting means 152 on the contact surface. However, such a design of the planes of shear is only suitable for separating relatively brittle materials.

For impact resistant materials the separating means according to FIG. 7 is used. The cutting means of this embodiment differs from that of the embodiment previously described essentially in that the first cup spring package is absent and thus no shock absorption of the cutting means takes place.

Figure 11:
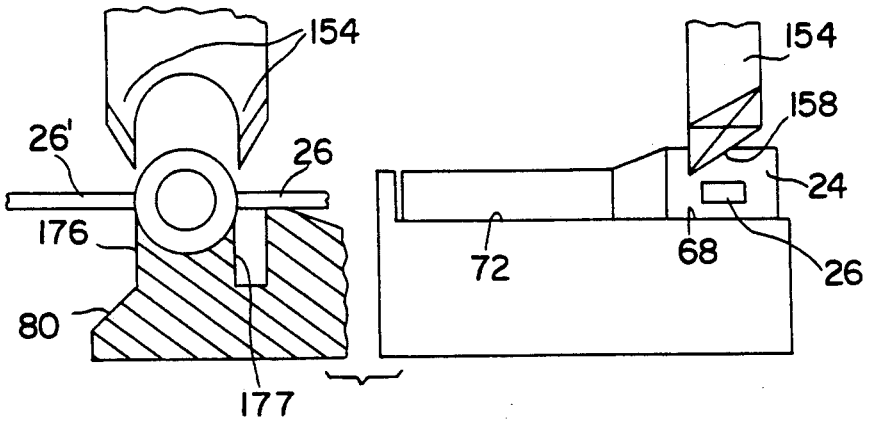
FIG. 11, a schematic representation of the separating means of hand tongs according to FIG. 7.

To improve the cutting effect, according to FIG. 11 perpendicular planes of shear 176, 177 are formed in prolongation of the cutting arms 154 on either side of the cavity 70 in the region of the ties 156, one plane of shear 176 being formed by a section 176 of the delivery surface 80 adjoining the cavity 70 and the other plane of shear 176, 177 being formed by a recess formed at least in the sleeve guide surface 68. The planes of shear 177 in each instance lie at a small parallel distance from the adjacent cutting arms 154, so that a cutting slot of preferably less than 0.05 mm is produced. An additional improvement in the separating effect is obtainable when the cutting edges 158 are set running obliquely upward with respect to the adjacent large surface of the connecting strap 26 (see FIG. 11). The depth of penetration of the cutting arms 154 along the planes of shear 176, 177 is to be adjusted through the adjusting screw 168 so that the cutting edges 158 do not come into contact with the delivery surface 80 or the floor of the recess. Transverse to the direction of transport, in the movable compression jaws 144, in the direction of feed W, the separating means 22 is followed by the sloping-roof-shaped upper die 74 (see FIG. 10), which, as described above, penetrates into the bottom die 72 of the anvil 16 and so the multiple-wire end sleeve 13 is crimped with the bare cable end 18 along the crimp section 28. Additional details concerning the shape and quality requirements of such crimping may be found in, for example, DIN 41611. Since the upper die 74 is a part subject to wear, it may be of advantage to fasten it replaceable in the insert 146. In the example described above, cable ends with a conductor cross section of 1.5 $mm^2$ are crimped. However, the hand tongs 1 can easily be converted to another conductor cross section by replacing the lower part 62 of the stationary compression jaw 60 and the insert 146 of the movable compression jaw 144. To minimize the weight of the hand tongs 1, it is advantageous to make the compression jaws 60, 144 of a diecast aluminum alloy, the bottom die 72 and the upper die 74 of a high-strength special steel.

For better understanding of the relatively complicated kinematics of the pressing tool according to the invention, its operation is described below in terms of the example of the hand tongs 1 according to FIGS. 4, 5 and 7. In the starting position, the first multiple-wire end sleeve 13 of the belt band 15 to be crimped is located in the cavity 70, while in the direction of transport Z a front connecting strap 26' is still connected with the end sleeve 13 (see FIG. 11). In the first step, the bare cable end 18 is introduced into the press section 28 of the end sleeve 13 (FIG. 2) through the centering opening 124 formed by the centering jaws 126 resting on one another. With the swing of the handle 10 the movable working arm 5 is closed via the four-bar mechanism 8, so that the upper die 74 at the end of the swing range of the handle 10 comes into contact with the crimp section 28 of the end sleeve 13 resting in the bottom die 72 and upon additional closing motion the latter is crimped with the cable end 18, the maximum compressive force being transmitted in the extended position of the coupling member 34 and the driving crank 36. With contact of the upper die 74 on the crimp section 28, the cutting edges 158 also come to rest on the connecting straps 15 and separate them along the ties 156, and the front connecting strap 26' slides out of the tongs 1 along the delivery surface 80. For further processing of the crimped components it is important that the cut edges of the connecting straps 15 remaining on the sleeve sections 24 project no more than 1/10 to 2/10 mm from the casing of the multiple-wire end sleeve 13. With the closing motion of the movable working arm 5, the centering jaws 126 are moved apart by contact of the wedge surfaces 150 of the opening wedge 148 on the stop pins 136.

The additional swing of the handle 10 causes the driving crank 36 to swing beyond the extended position, so that the movable working arm 5 opens easily and releases the end sleeve 13 crimped with the cable end 18. The latter may be withdrawn from the tongs 1, against the direction of feed W, through the enlarged centering opening 124.

Simultaneously with the compressing operation, swinging of the handle 10 in Y direction causes the transport fork 84 to be swung into the position of penetration and moved in the slide guide, against the direction of transport Z, until, due to spring action, it swings back into the perpendicular transport position behind the next end sleeve 13 of the belt band 15 to be crimped. In the end position of the handle 10 the catch member 116 engages in the groove 120, so that the following return swing of the handle 10 is at first not transmitted, via the transport linkage 86, to the transport fork 84. Only after a predetermined opening path of the movable working arm 5 is the engagement of the catch member 116 released, so that the transport fork 84 is moved, due to the spring pretension of the connecting rod 104, in the direction of the detent 100 and thus the next end sleeve 13 to be compressed is transported, along the guide surfaces 64, 66, 68, into the cavity 70. With contact of the transport fork 84 on the contact surface 100 and the complete return swing of the handle 10, the tongs 1 are ready for the next pressing operation.

Figure 12:
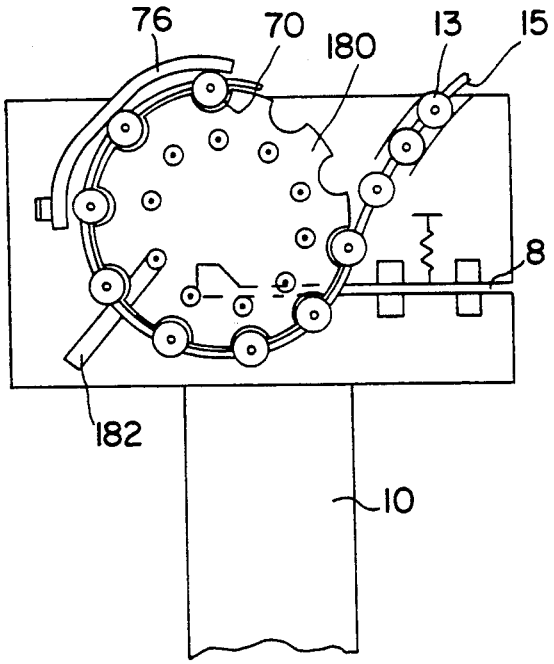
FIG. 12, a transport means of a further example of hand tongs.

The principle of the invention can of course alternatively be realized with other structural variants. Thus, the hand tongs 1 are by no means limited to the cable ends 18 being fed transverse to the direction of swing Y of the handle 10, but it is alternatively possible, for example, to feed the cable ends 18 in the direction of swing Y, i.e., from the left front side of the tongs 1, as viewed in FIG. 1. This requires, for example, that transport of the belt band 15 be effected transverse to the direction of swing Y of the handle 10. In this case, the push mechanism illustrated in FIGS. 3, 7 needs too much room. A more compact possible solution is offered, according to FIG. 12, by a transport drum 180, coupled rotatable to the transmission mechanism 8, with a catch means 182, at the periphery of which a plurality of cavities 70 are formed for receiving multiple-wire end sleeves 13. The uppermost end sleeve 13 in FIG. 12 is fixed in the crimping position by a hold-down member 76. The belt band 15 is fed to the transport drum 180 tangentially from a magazine (not shown), which is fastened to the stationary working arm of the tongs 1 in essentially the plane of rotation of the transport drum 180. The centering means assigned to the uppermost cavity 70 in FIG. 12, the separating means and the upper die are arranged one after another, corresponding to the orientation of the end sleeve 13, essentially parallel to the direction of swing Y of the handle 10, and are designed largely according to the examples described above, so that their description may be omitted at this point.

Figure 13:
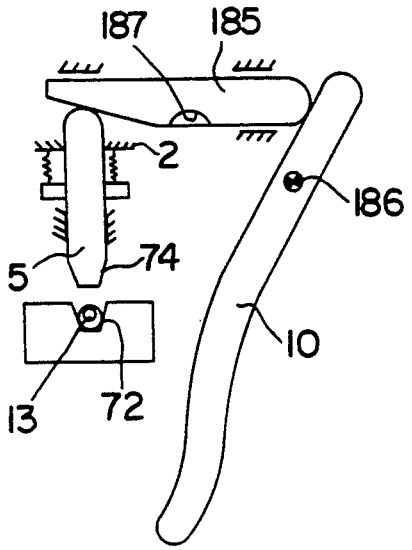
FIG. 13, a cam gear for transmission of handle motion to the movable working arm.

For transmitting the swinging motion of the handle 10 to the movable working arm 5, according to FIG. 13 a cam gear may alternatively be used. The handle 10, prolonged beyond its fixed linkage point 186, acts, via a cam plate 185 seated displaceable, on the movable working arm 5, seated displaceable in the basic body 2, on whose end section, situated in closing direction, the upper die 74 is fastened. The latter lowers down to the bottom die 72 for crimping of the end sleeve 13. A recess 187, which upon a predetermined swing of the handle 10 allows opening of the movable working arm 5, may be formed in the cam plate 185.

The relative arrangement of centering means, separating means, feed means, etc., to the upper die 74 and to the bottom die 72 may be effected as in the examples previously described.

Figure 14A:
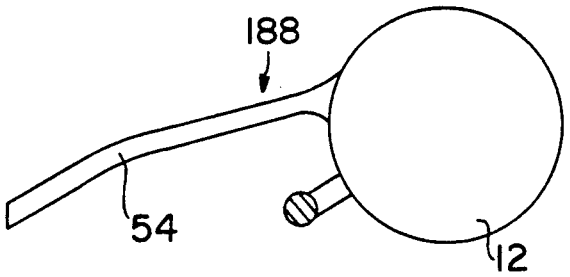
FIG. 14A, a magazine unit for accommodation and guidance of the belt band.
Figure 14B:
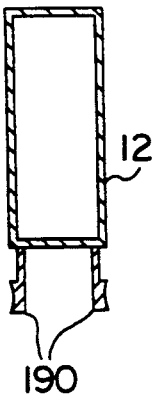
FIG. 14B, a cross section through FIG. 14A.

According to FIG. 14, the guide shaft 54 and the magazine 12 may be designed in one piece as replaceable magazine unit 188, which is lockable with the basic body 2 by way of detents 90. The magazine unit 188 advantageously may be made of synthetic material. In this case the magazine unit 188 is used as shipping packaging for the belt band which, after consumption of the belt band—as in the case of a printer ribbon—, is discarded or outer periphery, on the second hinge pin 40, so that relative motion between driving crank 38 and plate cam 208 is prevented.

Differing from the embodiment shown, the transport lever 201 and the plate cam 208, however, may alternatively be arranged on other components of the crimping tool movable relative to one another, which are in active communication with the movable handle 10. In addition, the tension spring 206 may, for example, be replaced by a torsion spring or spring clip which is supported coaxially on the bearing journal 202 and which acts with an arm on the transport lever 201 for pretension.

Figure 15:
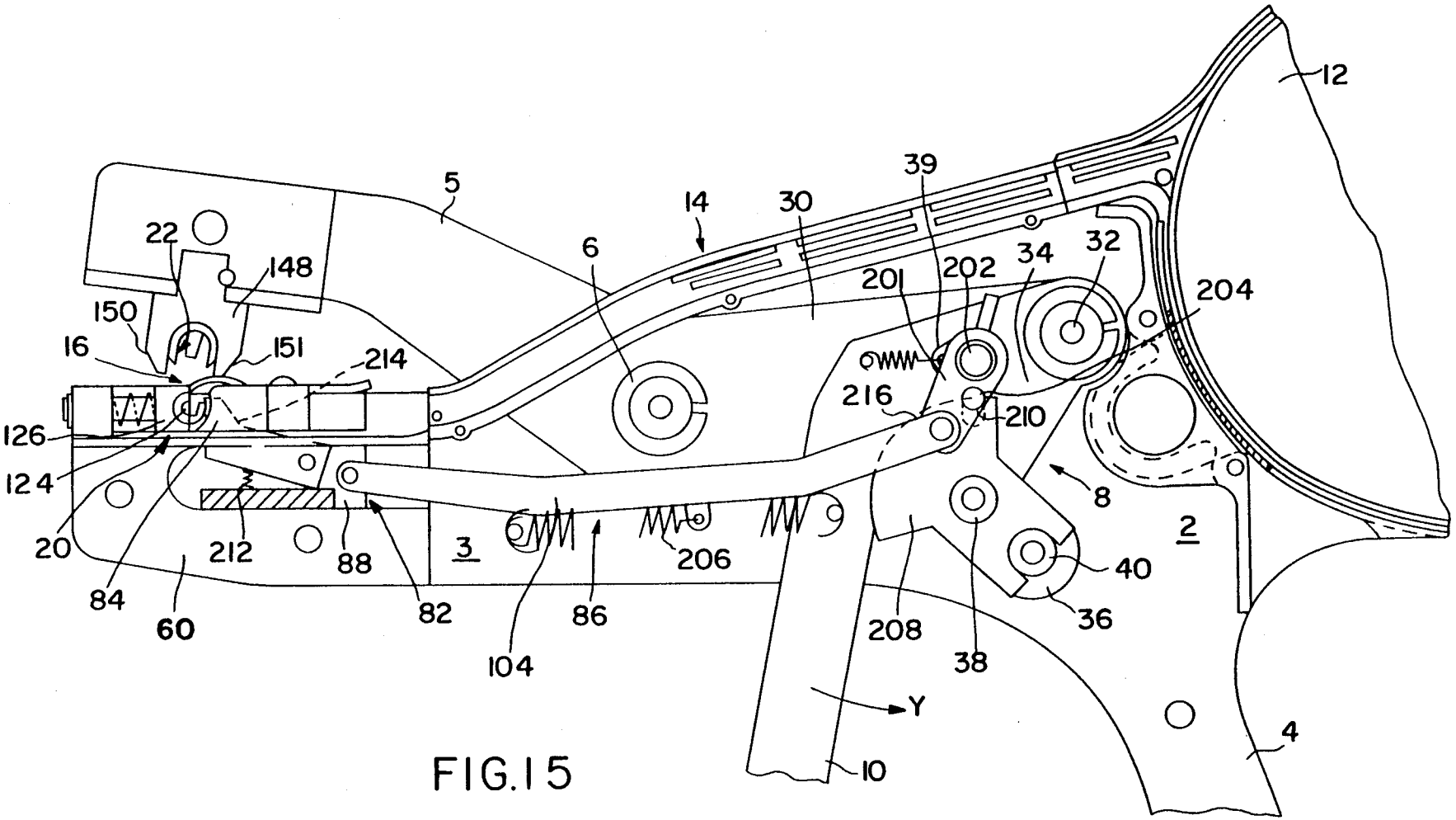
FIG. 15, a partial side view of another example of a crimping tool.

In the starting position of the movable handle 10 shown in FIG. 15, the pin 204 engages in a radial recess 210 of the plate cam 208.

The outer periphery of the plate cam 208 may be radially enlarged stepwise at the connection to the radial recess 210 of the outer periphery of the plate cam 208, so that upon the return motion of the coupling member 34 and of the driving crank 36, in the starting position shown in FIG. 1, the pin comes to rest on the radial step and thus the motion of engagement of the pin 204 in the radial recess 210 is supported.

A swing of the plate cam 208 (in this example about the hinge pin 40) caused by swinging of the movable handle 10 and hence of the driving crank 36 leads, owing to engagement of the pin 204, to a swing of the transport lever 201 and thus to a motion of the connecting rod 104. The control surface 216, adjoining the radial recess 210 seen at the left in FIG. 15, is formed, essentially coaxial to the second hinge pin 38, essentially circular as refilled by the manufacturer.

In FIGS. 15 to 19 another example of the invention with a modified transmission mechanism is provided, by means of which the transport motion of the component 13 can be influenced virtually as desired during the swinging motion. As in the examples described above, feed of the belt band or, more accurately, of the multiple-wire end sleeve to be crimped, is effected via the transport means 82 with the transport linkage 86, which according to FIG. 15 is linked to the movable handle 10 and the coupling member 34. According to the invention, the transport linkage 86 has the connecting rod 104, to whose end section facing the movable handle 10 is linked a transport lever 201. The latter is seated rotatable on a bearing journal 202 of the catch 39, which is fasted in the connecting section between the movable handle 10 and the coupling member 34, which in the example shown are formed in one piece. In the region between the articulation to the connecting rod 104 and the seat on the bearing journal 202, a pin 204 is arranged on the transport lever 201, which pin extends, essentially transverse to the longitudinal extension of the connecting rod 104, away from the surface of the transport lever 201. The latter, by means of a tension spring 106 supported on the bearing journal 202, is pretensioned in the direction of a plate cam 208, so that the pin comes to rest on its outer periphery. At the same time the tension spring 106 acts on the connecting rod 104 and is fastened to the basic body 3, so that the transport lever 201, via the connecting rod 104 with the pin 204, is brought into place on the plate cam 208. The plate cam 208 is seated, fixed against rotation, on the driving crank 36. In the example shown, the plate cam 208 is seated, in its midsection, on the second hinge pin 38 and, by a recess on the contact surface for the pin 204. The end section of the connecting rod 104 distant from the transport lever 201 is linked to a sliding block 88, which is guided along a slide guide in the stationary working arm 3 in the region of the anvil 16. Seated swinging on the sliding block 88, in a U-shaped receiving section 90, is the transport fork 84, which in the view according to FIG. 15 is designed L-shaped, the shorter arm in this view being capable of being brought into contact with the multiple-wire end sleeve to be transported. The peripheral edge of the shorter arm distant from the end sleeve to be transported is designed as contact section 214 for the adjacent end sleeve. The longer arm of the transport fork 84 in the view of FIG. 15 is seated swinging in the receiving section 90 and is pretensioned by a spring 212 in the direction of the movable working arm, which is supported at the base of the receiving section 90. In the starting position (FIG. 15) the fork sections of the shorter arm of the transport fork, projecting upward, embrace the connecting strap between the end sleeve located in the anvil 16 and the adjacent end sleeve, the transport fork 84 resting or being capable of being brought to rest on a peripheral section of the first end sleeve. The swinging motion of the transport fork 84 is limited by contact of the end section of the longer arm on the base of the receiving section 90.

Centering of the bare cable end is effected by way of the centering opening 124 of the centering means 20, which is formed by two centering jaws 126 pretensioned with respect to one another. These are capable of moving apart during the closing motion of the movable working arm 5 by contact of wedge surfaces 150, 151 of an opening wedge 148 on contact surfaces 218, 219. In this example the contact surfaces 218, 219 are formed by a recess of the centering jaws 126 of the stationary working arm, into which the opening wedge 148 is able to penetrate upon the closing motion of the workpiece. In the example described at the beginning, the contact surfaces are formed by stop pins, so that there is no need to provide the centering jaws 126 with a recess. There the width A of the recess is selected so that when the centering jaws 126 are closed the opening wedge 148 is unable to penetrate into the recess and rests, by its face joining the two wedge surfaces 150, 151, on the surface of the centering jaws 126, so that any additional closing motion of the tongs is prevented.

The centering opening 124 is selected slightly smaller than the cable diameter, so that the centering jaws 126 are moved apart by introduction of the cable end. This movement apart of the centering jaws, upon swinging of the handle 10, permits enlargement of the recess beyond the dimension A and hence insertion of the opening wedge 148 and closing of the crimping tool. In other words, the crimping tool is capable of closing only when the cable end has been introduced, so that maloperation of the crimping tool is reliably prevented when a cable end is not inserted.

Figure 17:
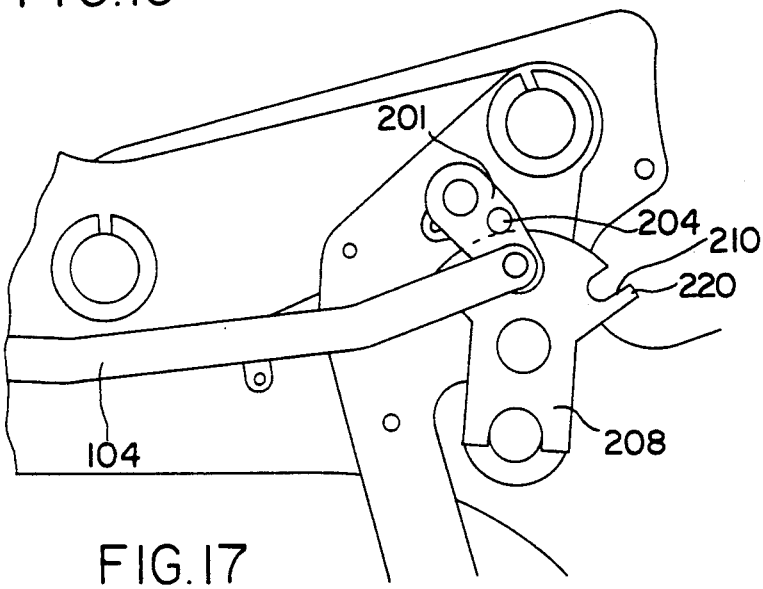
Figure 18:
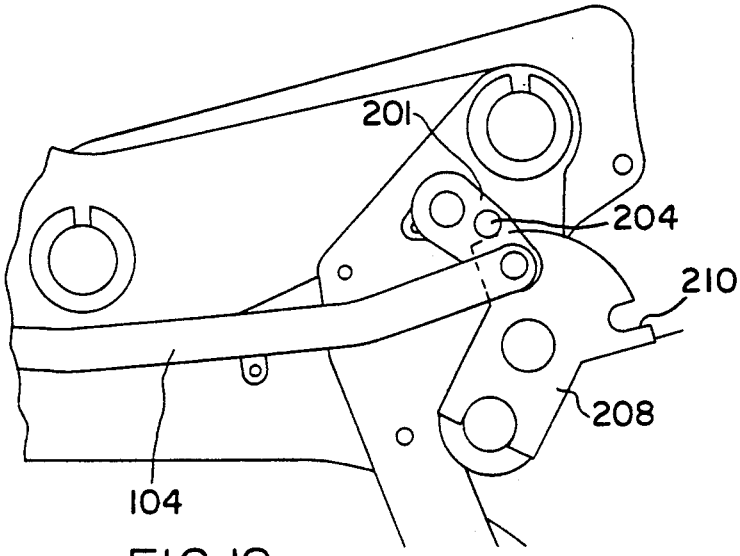
Figure 19:
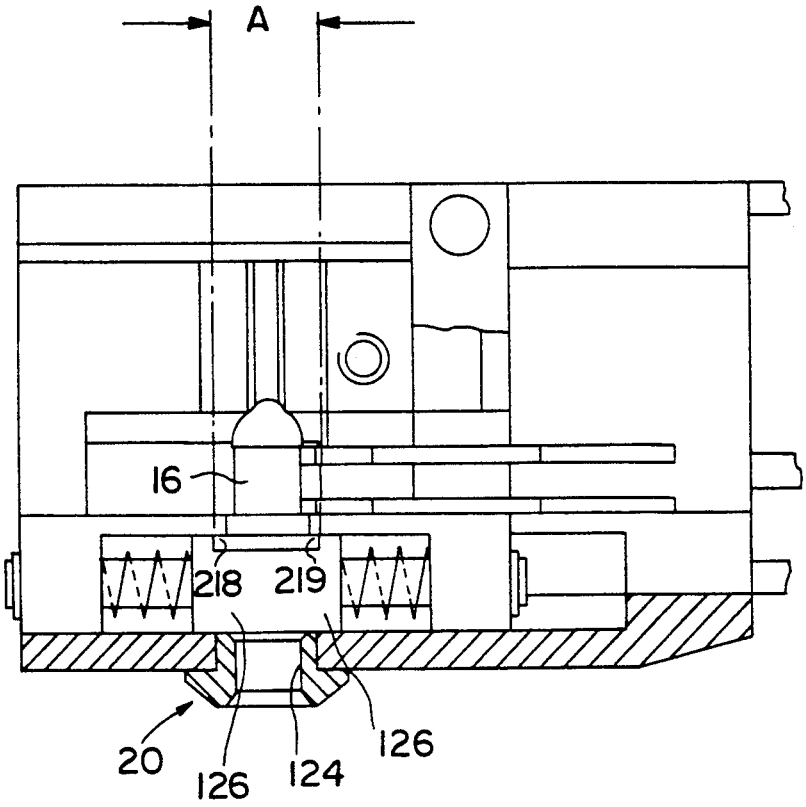
FIG. 19, a partial top view of the crimping tool of FIG. 15.

The motion of the transport linkage 82 according to the invention upon swinging of the movable handle 10 is explained in detail below, with the aid of FIGS. 16 to 18.

In the starting position of the movable handle 10 (see FIG. 15) the pin 204 engages in the radial recess 210 of the plate cam 208. The swing of the movable handle 10 causes the driving crank 36 to be swung over the coupling member 34, whereby the plate cam 208 is swung about the second hinge pin 40. Engagement of the pin 204 in the radial recess 210 transmits the motion of the plate cam 208 to the transport lever 201 and hence to the connecting rod 104. Since the transport lever 201 is linked to the bearing journal 202, which upon displacement of the handle 10 moves in a circle about the first hinge pin 32, the motion of the connecting rod 104, caused by swinging of the movable lever 10, results from superposition of the motion of the bearing journal 202 (directly caused by the swing of the handle 10) and of the swing of the transport lever 201 about the bearing journal 202.

Figure 16:
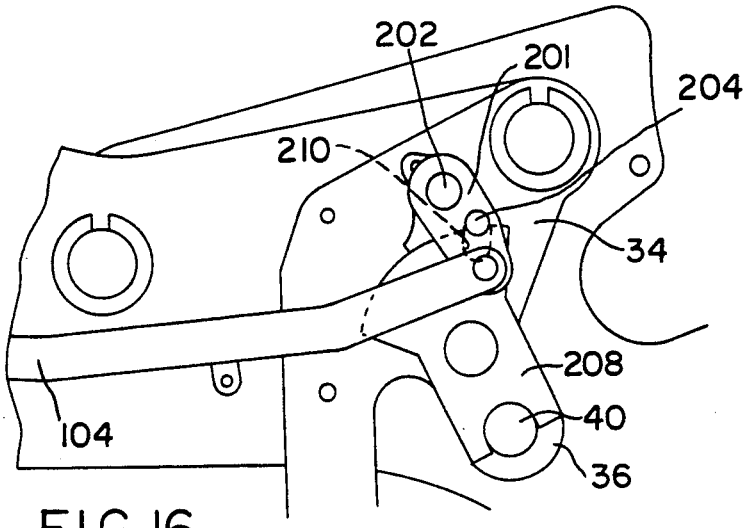
FIGS. 16 to 18, partial views of the transmission mechanism of FIG. 15 in various swing positions of the movable handle.

In a predetermined relative position of the plate cam 208 to the transport lever 201, the engagement of the pin 204 in the radial recess 210 is released, so that the pin 204 rests on the circular control surface 216 of the plate cam 208 (see FIG. 16). In this position the swinging motion of the plate cam 208 is no longer transmitted to the transport lever 201, so that its swing is determined only by the variation in distance of the contact point of the pin 204 on the control surface 216 from the bearing journal 202.

Upon additional swing of the movable handle 10, the driving crank 36 is moved into the extended position (FIG. 17) and beyond (FIG. 18), and the pin 204, due to the spring pretension of the spring clip 206, remains in contact on the control surface 216 of the plate cam 208. The curvature of the control surface 216 is selected so that the relative position of the pin 204 to the bearing journal 202 remains essentially constant and thus swinging of the transport lever 201 relative to the bearing journal 202 does not take place. When the pin 204 rests on the control surface 216, the motion of the connecting rod 104 is thus determined essentially by the motion of the bearing journal 202 on the circular path about the hinge pin 32. When the movable handle 10 moves back into its starting position, the motions previously described occur in reverse sequence. The motion of the connecting rod 104, caused by swinging of the movable handle 10, and hence the rate of motion of the transport fork 84, is thus substantially greater when the pin 204 engages in the radial recess 210 of the plate cam 208 than when the pin 204 slides along the control surface 216 and the motion of the connecting rod 104 takes place essentially directly via swinging of the handle 10. With the design of the transmission means and of the transport linkage according to the invention, the transport fork 84 is moved rapidly out of and into the region of the anvil 16 at the beginning of handle swing and at the end of the return swing motion, while in the intermediate ranges of swing of the movable handle 10 a slow forward feed motion of the transport fork 84 takes place.

Unlike in the examples described above, the forward feed motion of the transport fork 84 may alternatively be influenced without the formation of a radial recess 210 by only a suitable shaping of the control surface 216.

During the return motion of the transport fork 84, the contact section 214 comes to rest on the multiple-wire end sleeve to be transported into the anvil 16, so that the transport fork 84 is swung, against the pretension of the spring 212, in the direction of the base of the receiving section 90 of the sliding block 88, into the position of insertion. With additional return motion of the connecting rod 104, the transport fork 84 is moved back along the slide guide under the end sleeve to be transported, until the short arm of the transport fork 84 swings back into the transport position behind the end sleeve to be transported, so that the latter is fed into the anvil 16 by way of the transport means when the movable handle swings back.

Upon crimping of the end sleeve with the cable end in the extended position of the coupling member 34 and the driving crank 36, the crimp connection is plastically and elastically deformed, and the upper and lower cheeks of the crimp compression tool, more accurately, the working arms 3, 5, are elastically deformed as well, and the diameter of the crimp connection, upon partial opening of the working arm 5 at the end of the swing range of the handle 10, is increased by the percentage of elastic deformation. Since the anvil 16 again closes in the end swing position when the movable handle 10 moves back, when a crimp connection is inserted in the anvil 16 the compressive force necessary for elastic deformation of the said connection and of the working arms 3,5 would have to be applied to move the coupling member 34 beyond the extended position (FIG. 17) back into the starting position (FIG. 15). However, the spring pretension of the movable handle 10 is insufficient to apply this compressive force, so that the handle can be moved back into its starting position only when the crimp connection is removed. Since in this way the user is forced to remove the crimp connection from the crimping tool to be able to perform additional crimping, collision of an already compressed crimp connection with the following end sleeve fed into the anvil 16 is reliably prevented. The safety function described above, however, can only be obtained when the play of the movable components of the crimping tool associated with the motion of the movable working arm 5 is smaller than the elastic deformation of the crimp connection and working arms 3,5 upon compression.

Various modifications in structure and/or function may be made by one skilled in the art to the disclosed embodiments without departing from the scope of the invention as defined by the claims.

What is claimed is:

1. A crimping tool for compressing an electrical component onto a conductor to form a crimp connection comprising:

anvil means formed by two compression jaws which are relatively movable toward one another for applying compression to the electrical component disposed between the jaws and relatively movable away from one another for removal of the crimp connection from between the jaws;

a stationary working arm being connected to one of the jaws, the stationary working arm having an extending counter-holder;

a movable working arm being connected to the other of the two jaws, the movable working arm having an extending handle which can be swivelled toward the counter-holder;

transmission means connected to the handle for swivelling the handle and causing the jaws to move toward one another for applying compression force to the electrical component and at the end of the same swivel to cause the jaws to move away from one another for removal of the crimp connection; and feed means, responsive to the swivelling of the handle, for delivery of the electrical component to the anvil.

2. Crimping tool according to claim 1 wherein the anvil means includes a cavity for receiving the conductor and centering means for guiding the conductor to the cavity.

3. Crimping tool according to claims 1 or 2 wherein the feed means includes a magazine for accommodation of the electrical components.

4. Crimping tool according to claim 3 wherein the magazine is a drum for the accommodation of a belt band in the form of a spool, the electrical components being equally spaced on the band.

5. Crimping tool according to claim 3 wherein the magazine is removably fastened to a body of the tool.

6. Crimping tool according to claim 5 wherein the magazine is formed as one piece and includes a guide shaft extending to the anvil means.

7. Crimping tool according to claim 3 wherein separating means is coupled to the magazine for the delivery of separate electrical components to the feed means.

8. Crimping tool according to claim 4 including separating means for separating the electrical component from the belt band.

9. Crimping tool according to claim 1 wherein the handle is under tension.

10. Crimping tool according to claim 9 wherein the feed means, a magazine for supplying the electrical components, and centering means for guiding the conductor to a cavity of the anvil means are each arranged on the compression jaw associated with the stationary working arm, and separating means having cutting means for delivery of the electrical components and an upper die of the anvil are arranged on the compression jaw associated with the movable working arm.

11. Crimping tool according to claim 10 wherein the upper die is replaceably fastened to the compression jaw associated with the movable working arm and a lower die is replaceably fastened to the compression jaw associated with the stationary working arm.

12. Crimping tool according to claim 11 wherein when the jaws are in compression, the centering means, the separating means and the electrical component disposed in the anvil means are arranged in a plane parallel to the direction of swivel motion of the handle whereby the conductor is capable of being fed in a plane transverse to the direction of swivel motion of the handle.

13. Crimping tool according to claim 11 wherein when the jaws are in compression, the centering means, separating means and the electrical component disposed in the anvil means are arranged in a plane perpendicular to the direction of swivel motion of the handle whereby the conductor is capable of being fed in the direction of the swivel motion of the handle.

14. Crimping tool according to claims 9 to 12 wherein the transmission means comprises a four-bar mechanism, the mechanism including a driven crank, a coupling member and a driving crank for connecting the stationary and movable working arms, the coupling member and the driving crank upon swivelling of the movable working arm are capable of moving beyond their extended positions to open the compression jaws at the end of the swivel of the handle.

15. Crimping tool according to any one of claims 9 to 12 wherein the transmission means includes a cam drive having a lever forming an extension of the handle and a displaceable cam plate, whereby after the crimp of the electrical component, the swivel of the handle causes the compression jaws to move away from one another.

16. Crimping tool according to claim 14 wherein the driving crank has teeth which during the swivel of the handle engage a tensioned safety catch whereby the return motion of the handle is prevented until the handle is fully swivelled.

17. Crimping tool according to claim 16 wherein the teeth are located at a free end of the driving crank, the other end of the driving crank having a hinge pin connecting the driving crank to the coupling member.

18. Crimping tool according to any one of claims 9 to 12 wherein the feed means has a transport drum for receiving a section of the belt band along its periphery, the drum being rotatable by the transmission means for delivery of the electrical component to be crimped.

19. Crimping tool according to any one of claims 9 to 12 wherein the feed means includes a grip mechanism having a transport catch for engagement between two spaced electrical components on the belt band.

20. Crimping tool according to claim 9 wherein the feed means includes a sliding mechanism cooperating with a transport catch for transport of the belt band, the sliding mechanism being capable of swinging from a substantially horizontal insertion position between two adjacent electrical components on the belt band into a substantially vertical transport position.

21. Crimping tool according to claim 20 wherein the transport catch comprises a transport fork engaging a connecting strap of the belt band, the catch being displaceably guided in the direction of transport within the stationary working arm, the transport catch being connected to the handle by a transport linkage.

22. Crimping tool according to claim 21 wherein a connecting rod of the transport linkage is connected with the handle via a fork under tension, the fork having an oblong opening for guiding a carrier pin of the connecting rod whereby the motion of the fork in the direction of transport can only be transmitted to the connecting rod after a predetermined idle interval.

23. Crimping tool according to claim 22 wherein a stopping device engages the connecting rod under tension and the connecting rod is released at a predetermined swivel position of the movable working arm via the tension fork.

24. Crimping tool according to claim 23 wherein the stopping device has a catch member which is under tension and displaceable in the body, the catch member having an end section engaging with a groove of the connecting rod and whose engagement is capable of release by contact on an oblique surface of the tension fork.

25. Crimping tool according to claim 24 wherein the connecting rod after disengagement is displaceable by a compression spring in the direction of transport before the movement of the tension fork is transmitted to the connecting rod via the carrier pin.

26. Crimping tool according to any one of claims 22 to 25 wherein the tension fork has a forked end section which engages an adjacent end section of the connecting rod, the forked end section having arms forming the oblong opening for guiding the carrier pin.

27. Crimping tool according to any one of claim 10 or claims 20 to 25 wherein the feed means has a transition section to the cavity whereby the electrical component is guided between a holddown member and a guide of the stationary compression jaw.

28. Crimping tool according to claim 27 wherein the holddown member is forked to form an opening in the direction of transport and the separating means for separating a connecting strap of the belt band penetrates into the forked opening upon closing of the compression jaws.

29. Crimping tool according to any one of claim 10 or claims 22 to 25 wherein the centering means has a funnel-shaped centering opening in the region of the cavity formed by two centering jaws which are under tension and displaceably seated in the stationary compression jaw and are capable of moving apart for removal of the crimped electrical component.

30. Crimping tool according to claim 29 wherein each centering jaw forms a contact surface for an oblique guide coupled to the movable working arm, whereby during the swivel closing of the tool, each centering jaw is brought into contact with an associated contact surface for the separating movement of the centering jaw.

31. Crimping tool according to claim 10 wherein the centering means is under tension by a spring supported on the stationary compression jaw.

32. Crimping tool according to claim 10 wherein the centering means is under tension by a leaf spring supported on the stationary compression jaw.

33. Crimping tool according to claim 10 wherein the centering means is formed by jaws which are movable apart from one another via a parallelogram linkage linked to a pivoted lever.

34. Crimping tool according to claim 10 wherein the centering means is coupled to a centering funnel in the feed direction of the electrical component.

35. Crimping tool according to any one of claim 10 or claims 20 to 25 wherein the cutting means has two cutting edges engaging a peripheral section of the electrical component which is to be removably separated, each cutting edge having a plane of shear associated with the stationary compression jaw.

36. Crimping tool according to claim 35 wherein the plane of shear extends substantially parallel to a cutting arm of the cutting means.

37. Crimping tool according to claim 36 wherein the plane of shear is formed by a recess into which the cutting edge penetrates to separate the electrical components to be crimped.

38. Crimping tool according to claim 36 wherein each cutting edge faces a large surface of a connecting strap.

39. Crimping tool according to claim 35 wherein the cutting means is disposed by a cylindrical end section elastically in the movaable compression jaw.

40. Crimping tool according to claim 39 wherein the cutting means is under tension toward the stationary compression jaw via an adjusting screw and a second spring, one end of the second spring being supported on the stationary compression jaw and the other end of the spring being disposed on a support ring of the cylindrical end section.

41. Crimping tool according to claim 40 wherein the adjusting screw acts on the support ring via a first spring.

42. Crimping tool according to claim 40 wherein the adjusting screw is supported on the support ring.

43. Crimping tool according to claim 40 wherein the adjusting screw has a guide recess for an end section of the cylindrical end section.

44. Crimping tool according to any one of claim 8 or 20 to 25 wherein the electrical component is a multiple-wire end sleeve which is feed transversely to the longitudinal extent of the cavity, and the conductor is a cable having an end which is inserted into the end sleeve via the centering means.

45. Crimping tool according to claim 1 wherein the transmission means includes a control element for a transport linkage whereby the feed rate of movement of the electrical component can be controlled during the swivel of the handle.

46. Crimping tool according to claim 45 wherein the control element is a plate cam connected with a moveable element of the transmission means and the transport linkage is coupled with the plate cam by a transmission surface.

47. Crimping tool according to claim 46 wherein the plate cam is fixed against rotation on a hinge pin connecting a drive crank with a coupling member.

48. Crimping tool according to claim 47 wherein the transport linkage has a connecting rod having an end which is spaced from a transport fork and linked to a transport lever, the transport lever being rotatably linked to the handle and to the coupling member and supported on the plate cam by the transmission surface.

49. Crimping tool according to claim 47 wherein the transmission is supported on the plate cam under spring tension.

50. Crimping tool according to claim 47 wherein the transmission surface is formed by a pin which is arranged on a transport lever.

51. Crimping tool according to claim 46 wherein the plate cam has a control surface formed by a substantially circular recess by which the transmission surface engages the handle during the swivel of the handle whereby the movement of the plate cam is converted into a movement of the transport linkage.

52. Crimping tool according to claim 46 wherein an outer peripheral surface of the plate cam is radially stepwise enlarged with respect to a control surface.

53. Crimping tool according to claim 1 wherein the dimensional tolerances of the crimping tool are chosen such that the free movement of the movable working arm relative to the stationary working arm is smaller than the elastic deformation of the crimp connection and of the crimping tool during the crimping operation.

54. Crimping tool according to claim 30 wherein the inside diameter of the centering opening is smaller that the diameter of the conductor and the oblique guide rests on the contact surface only when the centering jaws are moved apart.

* * * * *